US011229310B2

(12) United States Patent
Beetstra

(10) Patent No.: US 11,229,310 B2
(45) Date of Patent: Jan. 25, 2022

(54) CURTAIN CONTROLLING DEVICE

(71) Applicant: IIM HOLDING B.V., Amsterdam (NL)

(72) Inventor: Kaj Beetstra, Amsterdam (NL)

(73) Assignee: IIM HOLDING B.V., Amsterdam (NL)

( * ) Notice: Subject to any disclaimer, the term of this patent is extended or adjusted under 35 U.S.C. 154(b) by 297 days.

(21) Appl. No.: 16/333,777

(22) PCT Filed: Sep. 14, 2017

(86) PCT No.: PCT/EP2017/073140
§ 371 (c)(1),
(2) Date: Mar. 15, 2019

(87) PCT Pub. No.: WO2018/065186
PCT Pub. Date: Apr. 12, 2018

(65) Prior Publication Data

US 2019/0208943 A1 Jul. 11, 2019

(30) Foreign Application Priority Data

Sep. 15, 2016 (NL) ..... 1042054

(51) Int. Cl.
*A47H 5/032* (2006.01)
*A47H 15/04* (2006.01)
(Continued)

(52) U.S. Cl.
CPC ..... *A47H 5/0325* (2013.01); *A47H 15/04* (2013.01); *E06B 9/322* (2013.01); *A47H 1/04* (2013.01)

(58) Field of Classification Search
CPC ..... A47H 5/032; A47H 5/0325; A47H 15/04; E06B 9/322; E06B 9/68; E06B 9/368
See application file for complete search history.

(56) References Cited

U.S. PATENT DOCUMENTS 4,995,442 A * 2/1991 Marzec ..... A47H 5/0325 160/331
6,144,177 A * 11/2000 Mao ..... A47H 5/03 160/331
(Continued)

FOREIGN PATENT DOCUMENTS

CA 2252347 A1 4/1997
CN 2376245 5/2000
(Continued)

OTHER PUBLICATIONS

Written Opinion of the International Searching Authority for PCT/EP2017/073140, dated Apr. 12, 2018.

*Primary Examiner* — Daniel P Cahn
*Assistant Examiner* — Poras Pradipkumar Patel
(74) *Attorney, Agent, or Firm* — Graeser Associates International Inc; Dvorah Graeser

(57) ABSTRACT

A device for moving objects by a driving cable. The device features two cable spools enabled to wind and unwind the cable on both sides. A remote cable pulley is arranged for guiding, at a remote location (X), the cable. The cable spools are arranged to exert, by means of constant torque springs, a cable pretension force in a direction (T) contrary to the unwinding direction (U) of the spools. Electric driving means are provided to be coupled either to the one or to the other cable spool, thus causing the cable to move from the one to the other cable spool or reversely, in order to move said one or more objects connected to the cable, or to be disengaged from both cable spools in order to enable manual operation of said one or more objects connected to the cable.

8 Claims, 5 Drawing Sheets

Figure 1A:
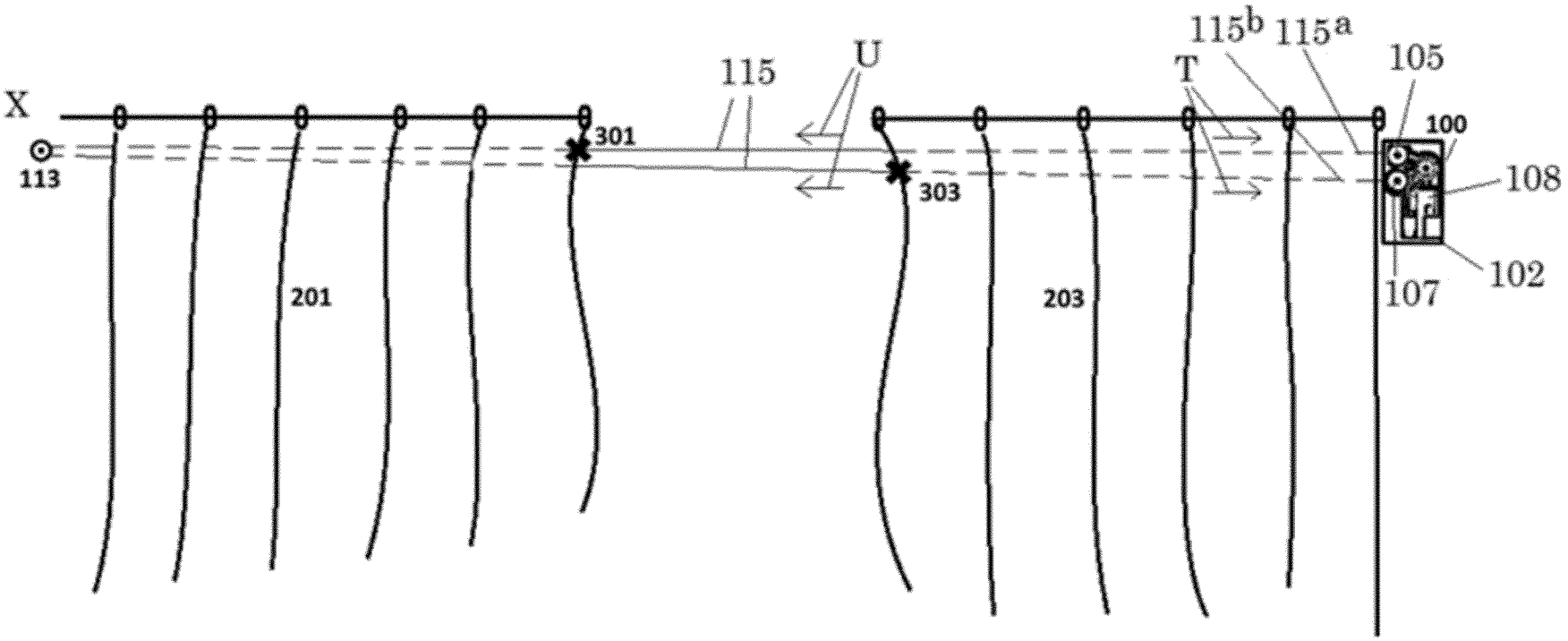

(51) Int. Cl.
*E06B 9/322* (2006.01)
*A47H 1/04* (2006.01)

(56) References Cited

U.S. PATENT DOCUMENTS

| | | | | |
|---|---|---|---|---|
| 7,337,825 | B1 * | 3/2008 | Erbe | A47H 2/00 160/310 |
| 2015/0129142 | A1 * | 5/2015 | Huang | E06B 9/262 160/370 |

FOREIGN PATENT DOCUMENTS

| | | |
|---|---|---|
| CN | 2568082 | 8/2003 |
| CN | 102908035 | 2/2013 |
| CN | 105919393 | 9/2016 |
| JP | H08154809 | 6/1996 |

* cited by examiner

CURTAIN CONTROLLING DEVICE

FIELD OF INVENTION

This invention relates to electric curtain movement, especially focused on the ability to attach to existing systems for in home or commercial applications.

BACKGROUND OF THE INVENTION

Conventional drapery rods provide a mount for curtains, blinds, and other window treatments which can be slid to closed or open positions. The typical support rod is a round or rectangular tube or another profile, wherein the rings or hooks (which hold the drapery) are able to slide within or upon the exterior of the tube. The rod is often mounted to either a wall or ceiling.

Drapery systems in residential and commercial setting have made significant improvements in the recent years. Nowadays, drapery rods can have an internal system of gears and pulleys along with flexible members (such as a rope or cable) that can operate along the path the rod. The hooks or support rings are attached to this flexible member and can therefore follow the same path along the length of the rod. The movement of the flexible member can be manually-powered or driven by a motor and can therefore be set to the desired closed or open position.

There is a general need for moving drapery automatically. It can be a luxurious option to someone's home or it can be a big convenience, especially for people that are less able to move around freely themselves.

Conventionally, these systems consist of the flexible member moving in a closed loop. Such a system can for example be found in U.S. Pat. No. 0,066,734 (A1). The flexible member has a predefined length and can rotate in a circular pattern. The hook or ring at the end of the drapery is attached to a specific point on the flexible member allowing it to follow its path. These systems will move the drapery from one side to the other, whereas one is to close and the other one is to open the draperies, or move two parts of drapery from the end of the rod to the center (or vice versa).

The biggest drawback for these systems is, as mentioned above, that the drapery systems need to match the desired length prior to installation. Consequently, the motorized drapery rods need to be custom build for each respectively different window. This not only drives up the costs it also increases the assembly time and restricts widespread use.

Furthermore, if a mistake has been made in the production process or in measuring the right length, the rod cannot simply be extended or shortened.

In U.S. Pat. No. 0,075,734 (A1) a drapery curtain rod is described which partly tackles the above sketched problem. It is a drapery rod that can be easily extended or shortened due to an innovative mechanical solution. However it still has some drawbacks that need to be considered: although the rod length is flexible it still needs some technical skill to mount to a ceiling; the use of a constant loop requires the driving pulley to have a good grip on the flexible member. It is therefore necessary that the tension on this flexible member remains high. Therefore the system will be either difficult to extend or the driving pulley will occasionally loosen its grip on the flexible member, resulting in wearing out and/or losing its knowledge of the position of the drapery.

The last sketched problem of the grip can be tackled by using a spool or drum in the closed loop instead of a pulley.

Such systems can for example be found in U.S. Pat. No. 4,957,014 (A) or in patent JP2007252201 (A). These systems however also have their drawbacks. If the pulling cord keeps winding up it will eventually reach the end and start winding on top of the feeding part of the cord. This will result in heavy friction and eventually corrosion. So the drum has to be extremely long and/or the circumference must be big in order to avoid this problem. This results in a huge device doing only a simple thing viz. pulling and feeding a cord.

The solutions sketched above are all complete systems, meaning that they consist of a complete rod with hooks. The biggest disadvantage of a complete system in this case is that it usually needs to replace an existing already mounted system. Thus, requiring a lot of time and technical skill. Furthermore the systems remain expensive due to high material and transportation costs.

Although there are numerous retrofit ("fitting the existing") solutions for automating vertical blinds, therefore not having the necessity of a complete system. There are hardly any retrofit solutions for horizontal moving drapery. One retrofit solution is proposed in patent JP2006061524 (A). Although this invention tackles some of the problems, there are still some major inconveniences that arise: the defined length still has to be set prior to installation as the system consists of two main units on both ends of a curtain rack. This suggests there are two power supplies needed on both sides; lastly, there is no manual control. In order to be able to control the system manually the spools need to wind freely. But if they wind freely the cord will start hanging. The moment a person pulls the attached hook towards the winding wheel (for example to open the curtain), the cord will become loose and will start hanging, resulting in a loose piece of cord in the middle of the curtain.

As a consequence of the art, the manufacturing, installation and use of motorized drapery remains expensive and is generally installed solely in luxury homes and hotels. As such, there is a continuing and unmet need for an easy to 'adjust, attach and automate' drapery system. Being able to fit all sizes and hanging mechanisms, to be easily mounted on existing drapery and to take full automatic control over.

In an alternative form, the present invention might be specified as a system arranged for moving one or more objects like e.g. curtains etc., the system comprising a driving cable to be connected to said one or more objects, the system comprising two cable spools connected or to be connected to either sides of the driving cable and arranged to wind and unwind the driving cable at the relevant cable sides, and further a remote cable pulley arranged for guiding, at a remote location (X), the driving cable extending between both cable spools. The cable spools are arranged to exert a cable pretension force in a direction contrary to the unwinding direction of the spools, causing a continuous cable tension which prevents sagging of the driving cable.

The system, moreover, comprises electric driving means arranged to be coupled either to the one or to the other cable spool, thus causing the driving cable to move from the one to the other cable spool or reversely, in order to move said one or more objects (e.g. curtains etc.) connected to the driving cable, or to be disengaged from both cable spools in order to enable manual operation of the one or more objects connected to the driving cable, independent from the electric driving means.

In order to cause the cable spools to exert a cable pretension force in a direction contrary to the unwinding direction of the spools, the cable spools may be linked to one end of a constant torque spring.

The electric driving means, arranged to be coupled either to the one or to the other cable spool or to be disengaged from both cable spools, may comprise an electric motor and electrically actuated coupling means arranged for coupling the motor to the one or the other cable spool or decoupling the motor from the one and from the other cable spool.

The coupling means may comprise toothed wheels, or friction wheels or discs (e.g. discs etc.).

It shall be understood that the term "friction wheels" or "friction discs", or further used "friction surface", shall not be limited to friction means exclusively. One skilled in the art will understand that any coupling mechanism could be used, such as magnetic means, toothed means, gears or the like that enable coupling the corresponding elements.

The coupling means, arranged for coupling the motor to the one or the other cable spool or decoupling the motor from the one and from the other cable spool, may comprise an electric linear motor, e.g. a linear stepper motor, or may be implemented by using one of more solenoid.

Accordingly, it is now disclosed adjustable, retrofit and easy to attach curtain controlling device.

Hereinafter the invention will be elucidated more in detail.

Figure 1B:
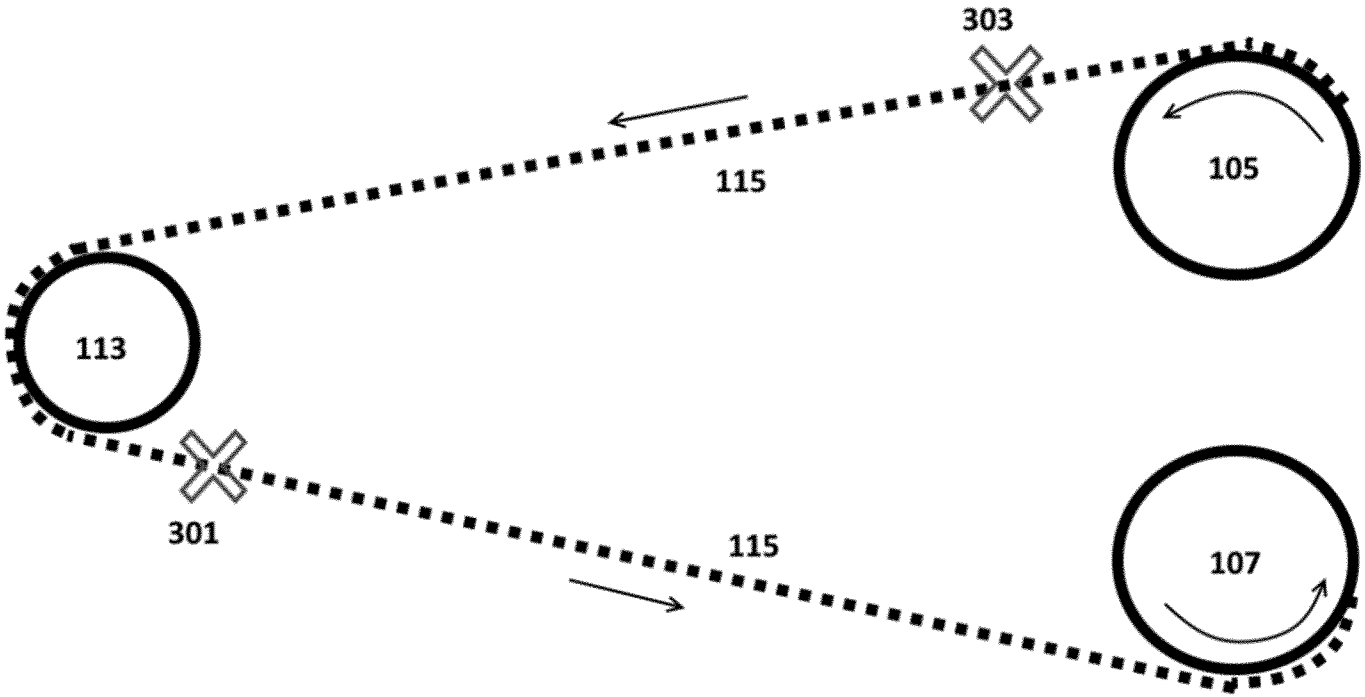

FIGS. 1*a-b* show schematically an overview of an exemplary embodiment of the invention;

FIGS. 2*a-d* show the embodiment of FIG. 1 more in detail;

FIGS. 3*a-b* show two alternative implementations of the driving gear.

Figure 4:
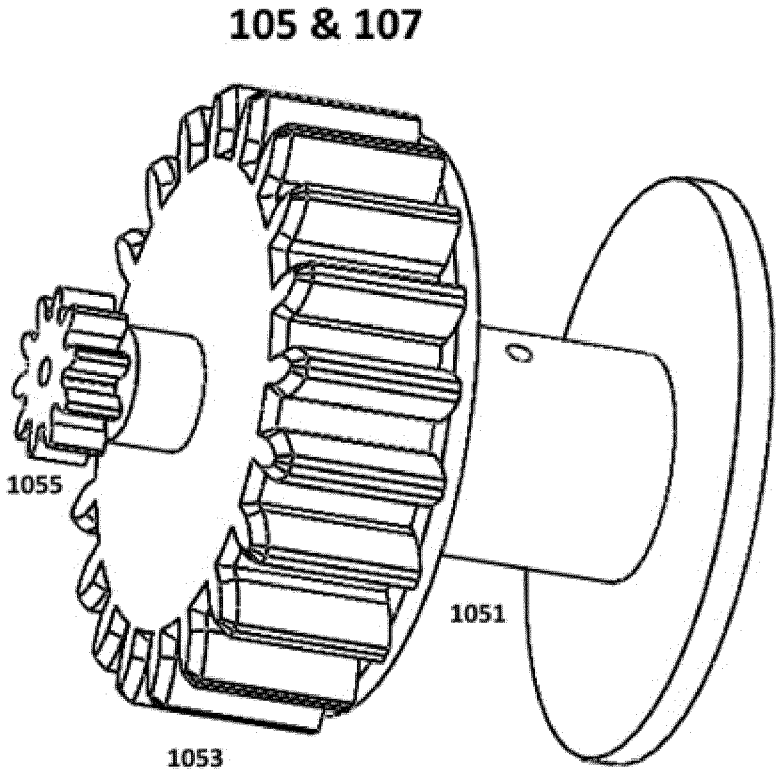

FIG. 4 shows the spool in detail.

Figure 2:
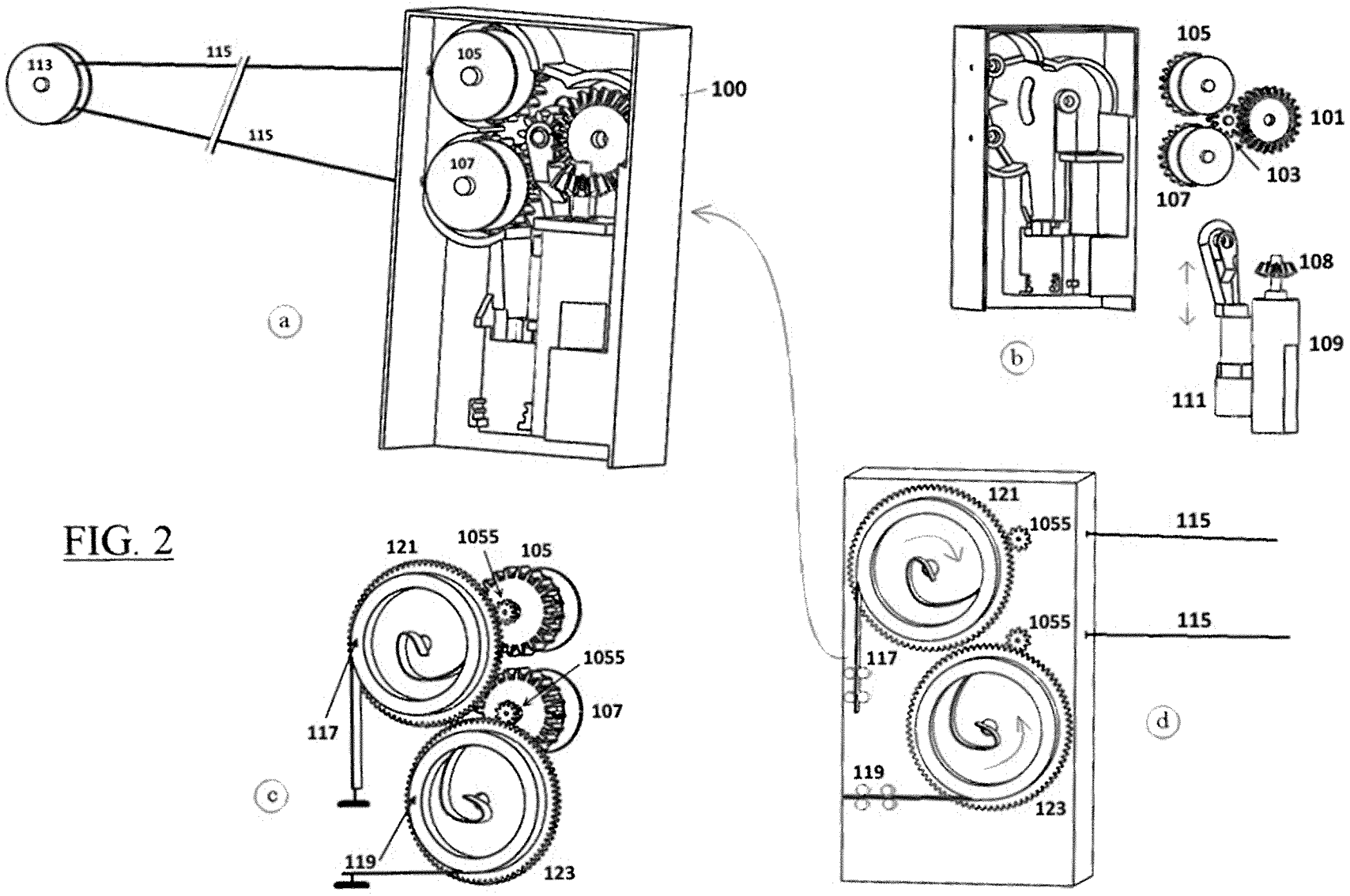
Figure 3:
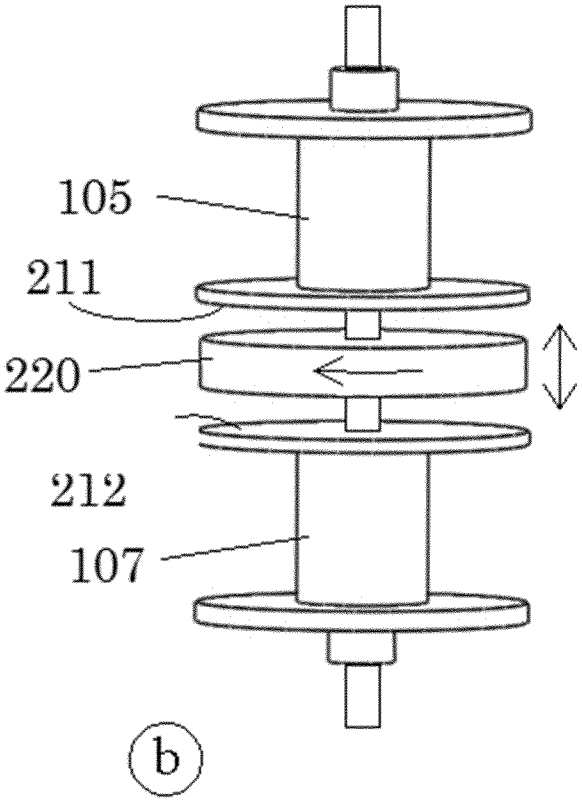
Figure 3:
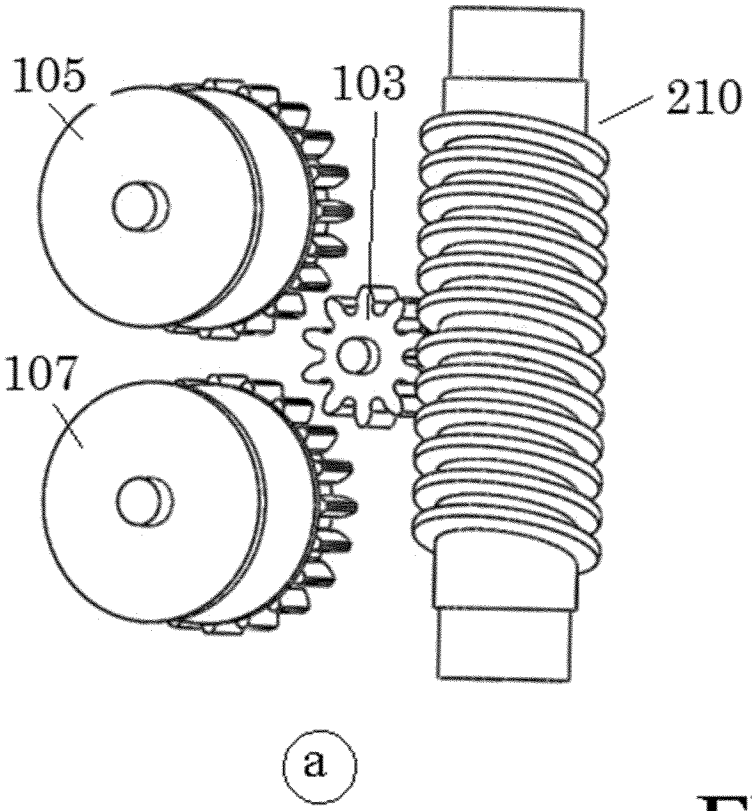

All FIGS. 1-3 show a system (100, incl. 113 and 115) arranged for moving objects (201,203) e.g. opening and closing curtains. The system comprises a driving cable or rope, called cable (115) hereinafter, to be connected (301, 303) to the objects, as well as two cable spools (105,107) connected (or to be connected) to either sides of the cable and arranged and enabled to wind and unwind the cable at the relevant cable sides (115*a,b*). A remote cable pulley (113) is provided for guiding, at a remote location (X), the cable which extends between both cable spools. The cable spools are arranged to exert a cable pretension force in a direction (T) contrary to the unwinding direction (U) of the spools. The system, moreover, comprises electric driving means (108) arranged to be coupled either to the one or to the other cable spool, thus causing the cable to move from the one to the other cable spool or reversely, in order to move the objects connected to the cable, or to be disengaged from both cable spools in order to enable manual moving (sliding) operation of the objects connected to the cable.

FIGS. 1*a-b* show an overview of an exemplary embodiment of the complete system, where FIGS. 2*a-d* some system components more in detail.

FIG. 2*a* shows a casing (102) housing the cable spools (105,107), provided with a circumferential toothing, as well as gear wheels (101 and 103) and electric driving means (108). FIG. 2*b* shows the same in "exploded view".

The electric driving means (108), arranged to be coupled either to the one or to the other cable spool or to be disengaged from both cable spools, comprise an electric motor (109) and electrically actuated coupling means (111), e.g. a linear stepper motor, a linear actuator, a servo, a DC motor, a solenoid and the like, arranged for coupling, by sliding gear wheel or pinion (103) upwardly or downwardly, the motor to the one (in upper position of gear wheel 103) or the other cable spool (in lower position of gear wheel 103) or decoupling the motor from the one and from the other cable spool (in the middle position of gear wheel 103).

FIGS. 2*c* and 2*d* show that the cable spools 105 and 107 are linked, via toothed pinions (1055) engaging circumferentially toothed discs (121, 123), to one end of a wound constant torque spring (117,119), causing the cable spools 105 and 107 to exert a cable pretension force in a direction contrary to the unwinding direction of the spools. The inner ends of the wound constant torque springs (117,119) are fixed to the centres of the toothed discs (121,123), while the outer spring ends are fixed to the housing (102).

FIG. 3*a* shows an embodiment wherein the gear wheel (101) is replaced by a worm wheel (210), which may be driven by electromotor (109).

FIG. 3*b* shows schematically an embodiment wherein the two cable spools (105, 107) may be driven via a friction disc (220) which may be rotatably driven by electromotor (109) and moved upwardly and downwardly by the coupling means (111), e.g. linear actuator of (stepper) motor or servomotor, which are arranged to position the rotating friction disc (220) to the upper position thus engaging a friction surface (211) of the upper cable spool (105), or to position the rotating friction disc (220) to the lower position thus engaging a friction surface (212) of the lower cable spool (107), or to position the rotating friction disc (220) in its middle position, between the friction surfaces of both cable spools (105, 107).

Hereinafter the exemplary embodiment of FIGS. 1 and 2 will outlined more in detail, including the installation and operation of the system.

1. The Starting Point, Before the Device is Attached to a Drapery System.

The device (100) consists of an open loop system with two small spools (105 & 107) and one pulley (113). The spools are not connected to each other so that they can rotate independently of one another. There is one long thin cord or cable (115) wound up on these spools. If the device is not operated, meaning none of the motors are spinning and transferring their torque onto the spools, the spools can rotate freely. This way, the cord can be easily pulled out of the device, the user can easily set the length needed, and is therefore easy to install on all kinds of horizontal moving drapery (this will be further elaborated in the next section). The cord moves along a pulley (113) which, in the installation procedure, will be mounted on the opposite side of the drapery. The pulley makes it possible for the cord to run smoothly in this open-loop system.

2. Installation Procedure.

The whole device, with the pulley and cord included, must be hung on the back of the drapery system (201&203), in between the drapery track and the windows. The device (100) and the pulley mechanism (113) must each be attached at the end of the drapery system. They can be attached in three different ways: clamped to the drapery fabric, mounted on the drapery track or mounted on the wall.

The cord must be attached to both inner ends of the draperies (the part that is being pulled if one closes or opens the draperies) (301 & 303). It can also be clamped to the fabric or attached to the gliders of the drapery track. FIG. 1 shows a schematic view of a drapery system that consists of two sides that are closing in the middle. A drapery system that only closes at one side is operated in the same way (it only lacks one 'inner end').

In one alternative embodiment of the subject invention, once the system is mounted and adapted to the draperies to be moved, the user can connect both spools (105, 107) making them rotate synchronous. Accordingly, one end of the cable is wound up clockwise on one spool and the other end of the cable is wound up counterclockwise on the other spool (one spool winds up the cable and the other one unwinds it). In this case, use of the constant torque springs (117,119) would not be required.

3. The Spools

The spools (105 & 107) are made up of three parts, as shown on FIG. 4:

a. A spool (1051) to wind up the cord.

b. A gear (1053) to receive torque from the DC motor (109). This gear is only driven when the device is in motion. This will be further elaborated in section 4.

c. A small gear (1055) to receive a small constant torque. This gear is always connected to a constant torque spring making it always want to wind up. This will be further elaborated in section 7.

4. In Motion

The device has two motors: one electric (109), e.g. DC motor, and one mini Linear Actuator, acting as coupling means (111).

The DC motor (109) causes a rotary force. This force is transferred from the bevel gear (101) to the small coupler gear (103) and onto one of the two spools (105 & 107) making it spin. The cord will be wound up and the drapery will be pulled to a desired side. The Linear Actuator (111) pushes the small coupler gear (103) up or down, making it connect to either the top spool (105) or bottom spool (107), depending on the desired direction of the drapery movement. An example for being in motion: when the top spool (105) is being driven by the DC motor (109), the bottom spool (107) is not connected to the small coupling gear (103) and can therefore run freely. This way, the bottom spool (107) can give as much cord as the top spool (105) is winding up. The cord that is being wound up on the top spool (105) is attached to one 'inner end' of the draperies (301 or 303). In the example drawing in section 2 it would be the left drapery (301). Resulting in the movement of the drapery to the right.

When the device is in standby mode, waiting for an input, the small coupler gear (103) is located exactly in the middle of the two spools (105 & 107), not touching either one of them. Therefore, they can run freely making it possible for the drapery to be moved by hand. This will be further elaborated in section 6.

5. Determining the Location of the Draperies

It is necessary for the device to know the exact location of the draperies. With this information the device will know how much cord must be wound up to make the curtains open or close. To accomplish this, both spools are connected to a 'speed sensor'. These sensors measure the rotation and therefore exact location of the spools.

6. Moving the Drapery by Hand.

If the device is not in operation (stand-by mode), the spools can run freely. This means that the drapery is also able to move freely and can therefore be opened or closed by hand. Although there is no cord tension coming from the DC motor (109) on the cord (115), it is necessary to keep a small tension so that the spools will always want to wind up. Therefore, the spools are each connected to a constant torque spring (117 & 119). The small gears on the spools (1055) are each connected to a large gear (121 & 123) creating a speed reduction. The constant torque spring (117 & 119) are connected in the center with the larger gears (121 & 123). When the cord from the spools is being pulled the constant torque springs (117 & 119) are slowly being tensioned. Hereby creating permanent tension on the spools making them want to wind up themselves.

The invention claimed is:

1. A curtain controlling device for opening and closing curtains, characterized in that it comprises an open loop system with two cable spools, one pulley and one driving cable, wherein said cable is wound up on these spools, each end of said cable being connected to one of said spools; said cable spools are arranged to wind and unwind the cable at the relevant cable ends; said pulley is a remote cable pulley guiding, at a remote location, the said cable which extends between both spools, wherein the cable spools are arranged to exert a cable pretension force in a direction contrary to the unwinding direction of the spools; the device further comprises an electric driving means, wherein said electric driving means comprises an electric motor and electrically actuated coupling means for coupling the motor to the one or the other cable spool and decoupling the motor from the one and from the other cable spool, thus causing the cable to move from the one to the other cable spool or reversely, in order to move said curtain connected to the cable, or to be disengaged from both cable spools in order to enable manual moving said curtain connected to the cable.

2. The device according to claim 1, wherein the cable spools are linked to one end of a constant torque spring, causing the cable spools to exert a cable pretension force in a direction contrary to the unwinding direction of the spools.

3. The device according to claim 2, wherein the cable spools are linked, via toothed pinions engaging circumferentially toothed discs, to one end of said constant torque spring.

4. The device according to claim 1, wherein the coupling means comprise toothed wheels.

5. The device according to claim 1, wherein the coupling means comprise toothed wheel and worm wheel.

6. The device according to claim 1, wherein the coupling means comprise friction disc.

7. The device according to claim 6, wherein the cable spools comprise friction surfaces.

8. The device according to claim 1, wherein the coupling means, arranged for coupling the motor to the one or the other cable spool or decoupling the motor from the one and from the other cable spool, comprise an electric linear motor, preferably a linear stepper motor, or servomotor.

* * * * *